US010027043B2

(12) United States Patent
Zhang et al.

(10) Patent No.: US 10,027,043 B2
(45) Date of Patent: Jul. 17, 2018

(54) ELECTRICAL CONNECTOR HAVING REINFORCING SHELL FOR MOUNTING AND OPERATION

(71) Applicant: FOXCONN INTERCONNECT TECHNOLOGY LIMITED, Grand Cayman (KY)

(72) Inventors: Wen-Fang Zhang, Kunshan (CN); Jian-Kuang Zhu, Kunshan (CN); Chun-Sheng Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/681,449

(22) Filed: Aug. 21, 2017

(65) Prior Publication Data

US 2018/0054007 A1 Feb. 22, 2018

(30) Foreign Application Priority Data

Aug. 19, 2016 (CN) ..... 2016 1 0689156
Aug. 19, 2016 (CN) ..... 2016 2 0904170 U

(51) Int. Cl.

| | |
|---|---|
| ***H01R 24/00*** | (2011.01) |
| ***H01R 12/51*** | (2011.01) |
| ***H01R 12/70*** | (2011.01) |
| ***H01R 13/432*** | (2006.01) |
| ***H01R 13/52*** | (2006.01) |

(52) U.S. Cl.
CPC ..... *H01R 12/51* (2013.01); *H01R 12/7064* (2013.01); *H01R 13/432* (2013.01); *H01R 13/5213* (2013.01)

(58) Field of Classification Search
CPC ..... H01R 23/02; H01R 24/60; H01R 24/62
USPC ..... 439/660, 607.35, 607.36, 76.1
See application file for complete search history.

(56) References Cited

U.S. PATENT DOCUMENTS

| | | | | |
|---|---|---|---|---|
| 9,017,092 | B1 * | 4/2015 | McCracken | H01R 13/62 439/374 |
| 9,520,683 | B2 | 12/2016 | Qian et al. | |
| 9,705,243 | B1 * | 7/2017 | McCracken | H01R 13/6205 |
| 9,705,263 | B2 * | 7/2017 | Huang | H01R 13/7175 |
| 9,728,915 | B2 * | 8/2017 | Aldehayyat | H01R 24/58 |

* cited by examiner

*Primary Examiner* — Phuong Dinh
(74) *Attorney, Agent, or Firm* — Wei Te Chung; Ming Chieh Chang

(57) ABSTRACT

An electrical connector includes an insulative cover enclosing the terminal module via an overmolding process. The cover includes a base and a tongue portion extending forwardly from the base and forming opposite mating surfaces thereon. The terminal module includes a plurality of terminals retained in the insulator wherein a contacting section of the terminal is exposed upon the mating surface. A pair of reinforcing metal plates are disposed upon the terminal module and enclosed by said cover except front portions of said reinforcing metal plates exposed outside of the cover.

11 Claims, 14 Drawing Sheets

ELECTRICAL CONNECTOR HAVING REINFORCING SHELL FOR MOUNTING AND OPERATION

BACKGROUND OF THE DISCLOSURE

1. Field of the Disclosure

The invention is an electrical connector, and particularly to the electrical connector having reinforced structure thereof.

2. Description of Related Arts

The traditional connector enclosed within the cylindrical holder, which is essentially linked by a cable, except the mating tongue and mounted upon a printed circuit board in the holder, includes an insulative cover enclosing the terminal module via an overmolding process while lacking the reliable metallic mechanism thereof to reinforce the whole connector structure, thus tending to be broken during some impact applied upon the connector.

A electrical connector with reliable strength thereof is desired.

SUMMARY OF THE DISCLOSURE

To achieve the above desire, an electrical connector includes an insulative cover enclosing the terminal module via an overmolding process. The cover includes a base and a tongue portion extending forwardly from the base and forming opposite mating surfaces thereon. The terminal module includes a plurality of terminals retained in the insulator wherein a contacting section of the terminal is exposed upon the mating surface. A pair of reinforcing metal plates are disposed upon the terminal module and enclosed in said cover except front portions thereof exposed outside of the cover.

An electrical connector assembly includes the aforementioned electrical connector enclosed within a cylindrical holder having a narrow slot extending along the longitudinal/axial direction wherein a root region of the tongue portion forms a pair of notches at two opposite ends along the longitudinal direction, to receive a portion the cylindrical holder, which is located at the inner end of the slot, and a distal end portion of sealing pole of the cap, respectively The reinforcing metal plates confront the narrow slot in a direction perpendicular to the tongue portion for efficiently resisting an impact, i.e., the shearing force, upon the tongue portion. A printed circuit board is disposed in the holder, on which the terminals, the reinforcing metal plates and the cover are mounted. The reinforcing metal plate further includes a mounting leg embedded within the mounting post of the cover for reinforcing securing between the cover and the printed circuit board.

DETAILED DESCRIPTION OF THE PREFERRED EMBODIMENT

Figure 1:
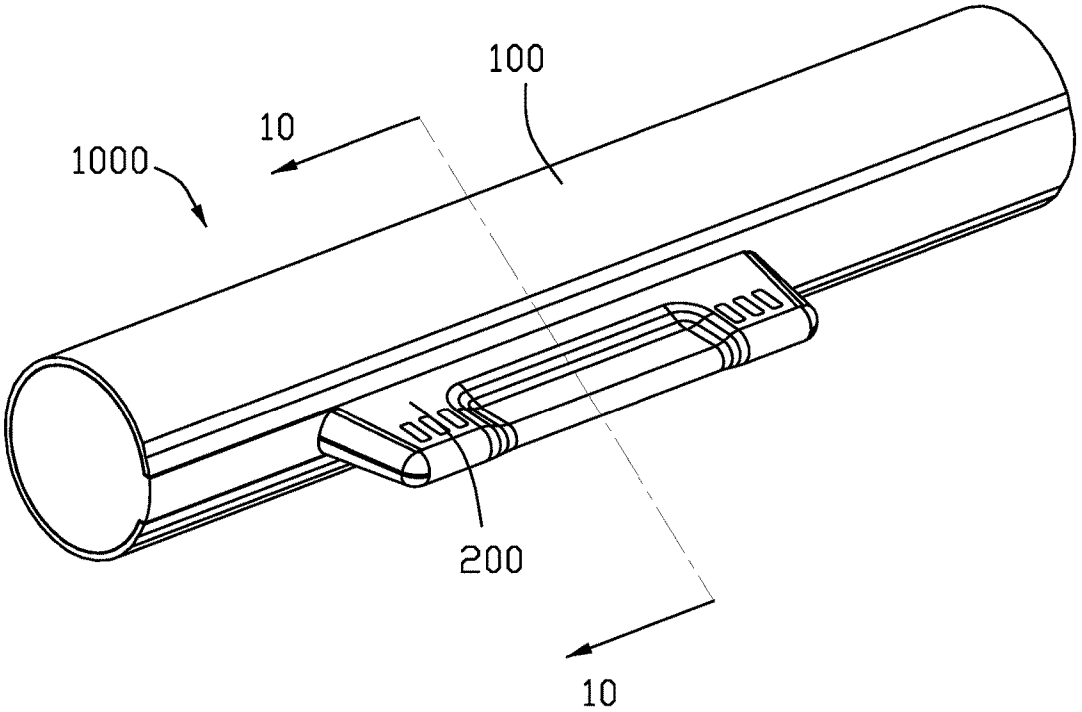
FIG. 1 is a perspective view of an electrical connector assembly of a first embodiment according to the invention.
Figure 2:
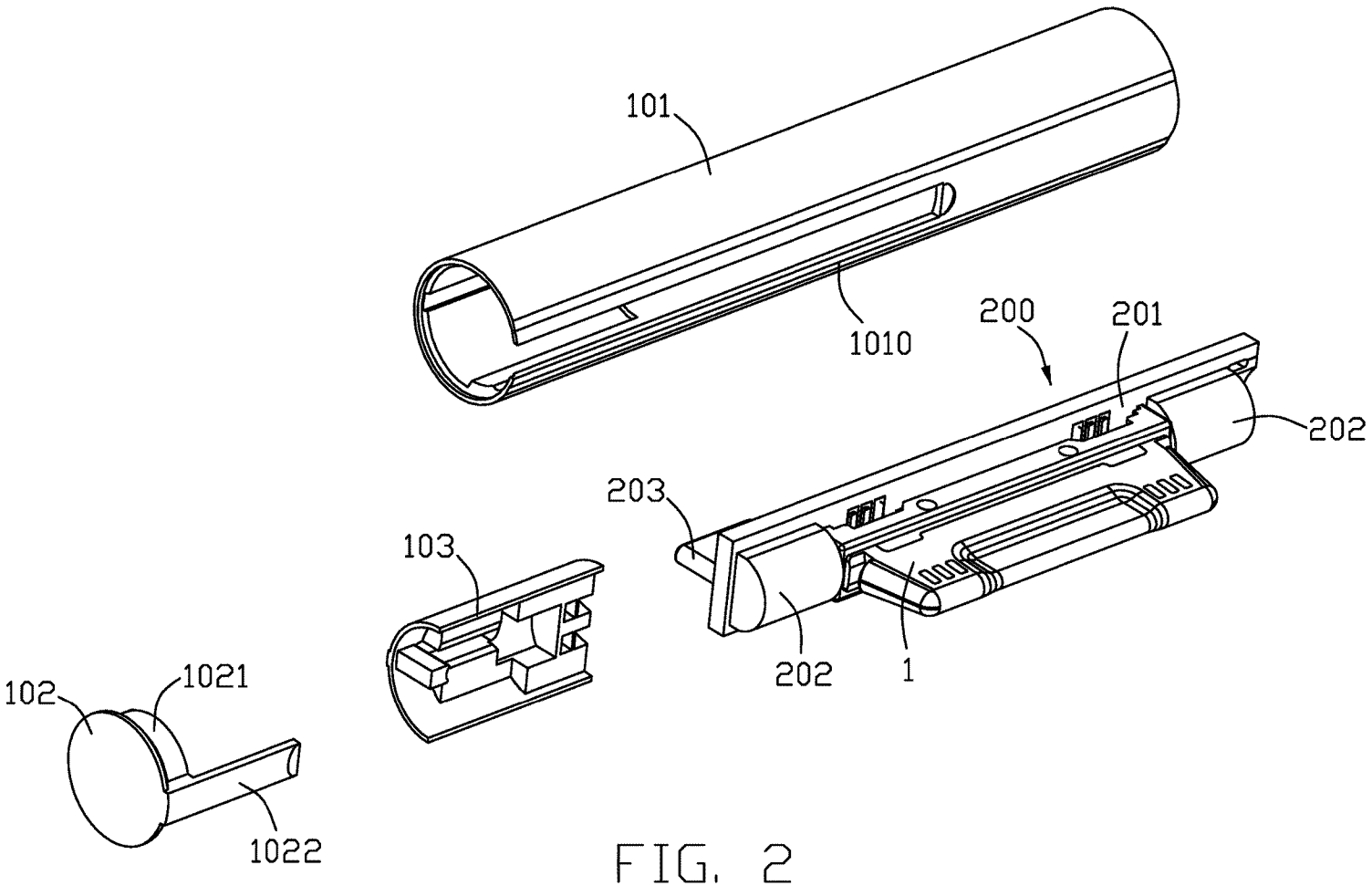
FIG. 2 is an exploded perspective view of the electrical connector assembly of FIG. 1.
Figure 3:
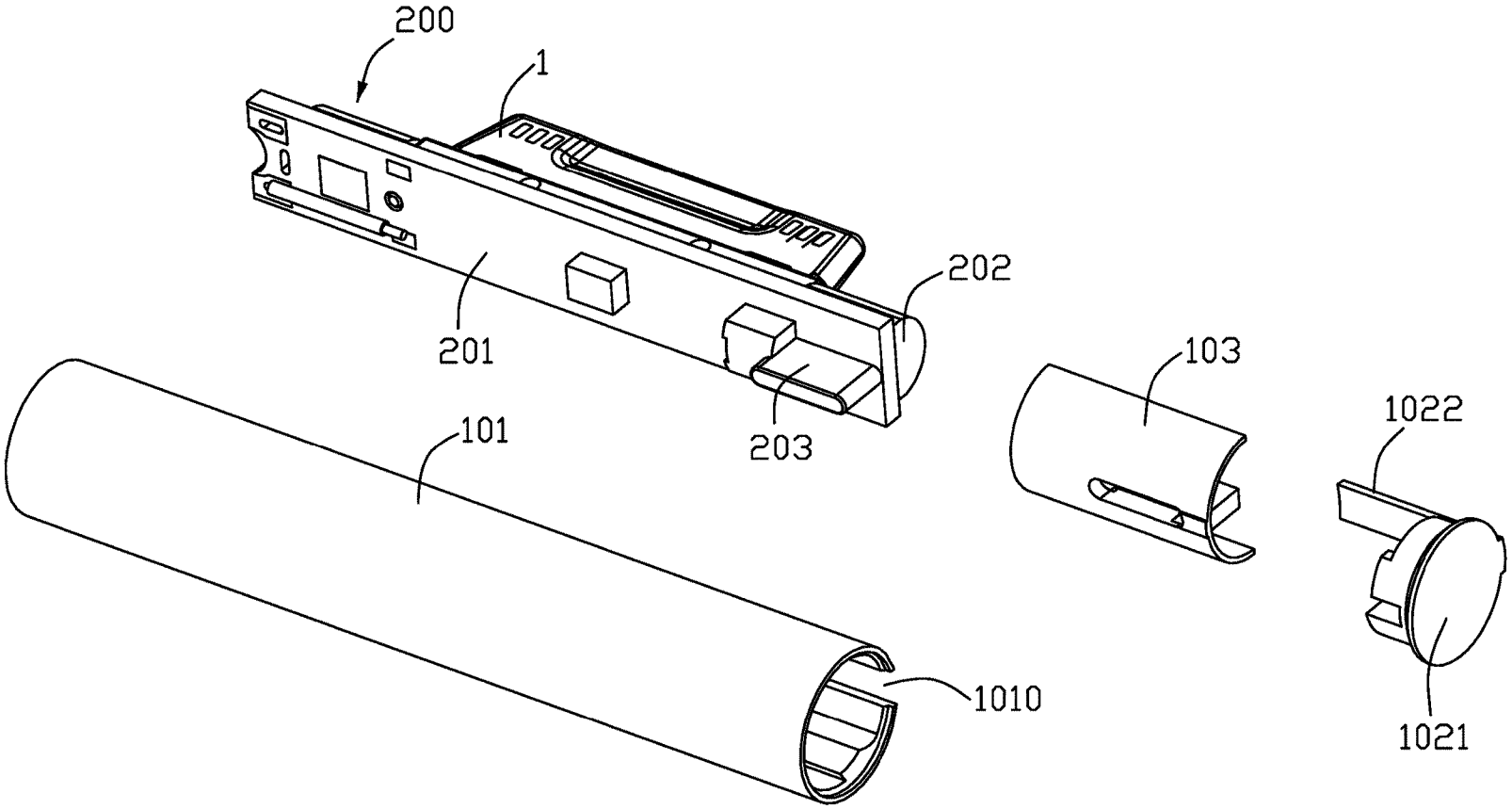
FIG. 3 is another exploded perspective view of the electrical connector assembly of FIG. 1.
Figure 4:
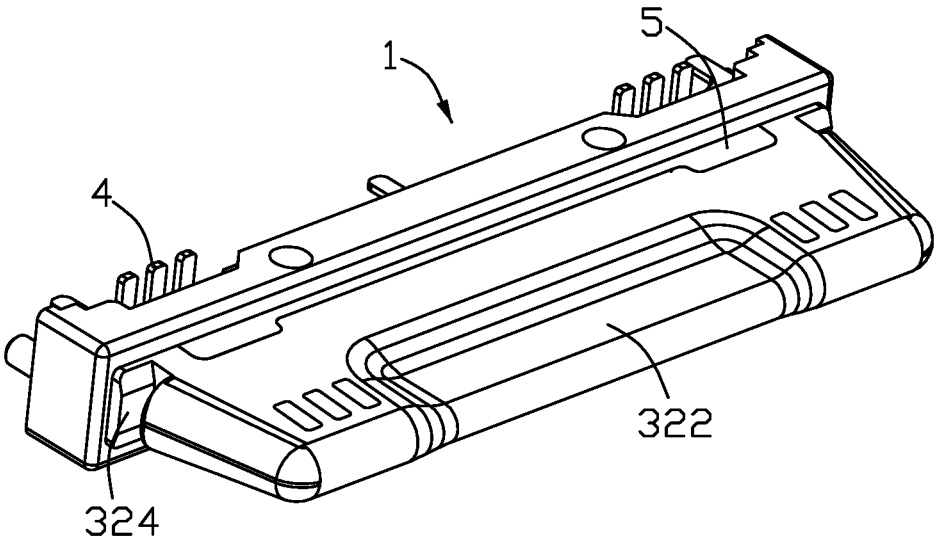
FIG. 4 is an perspective view of the electrical connector of FIG. 1 without showing the holder.
Figure 5:
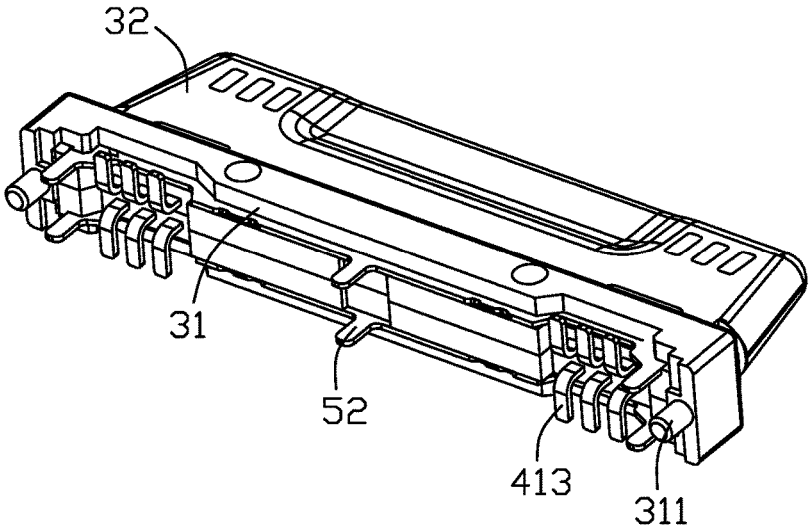
FIG. 5 is another perspective view of the electrical connector of FIG. 4.
Figure 6:
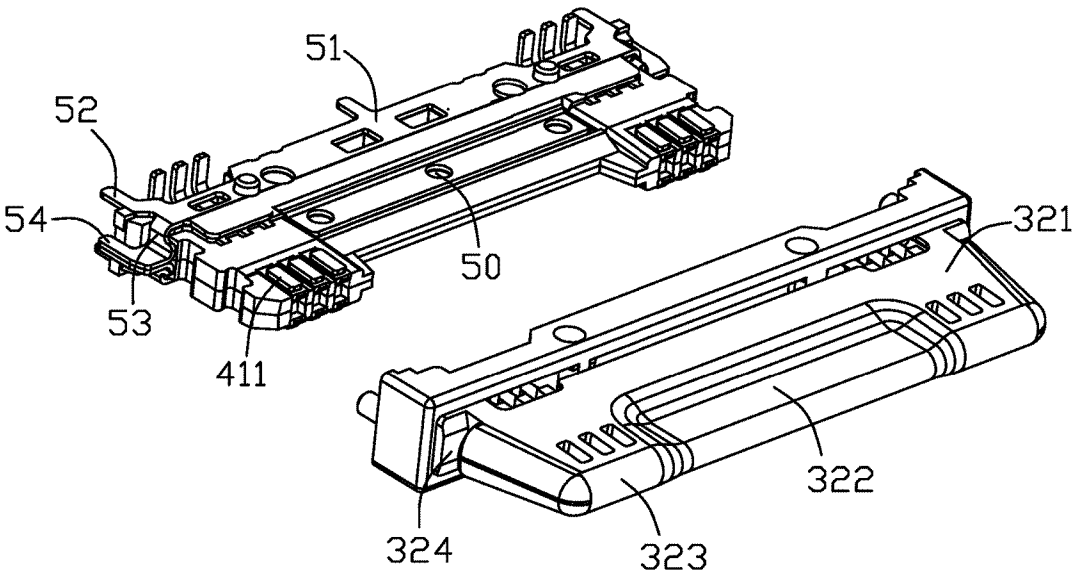
FIG. 6 is an exploded perspective view of the electrical connector of FIG. 4.
Figure 7:
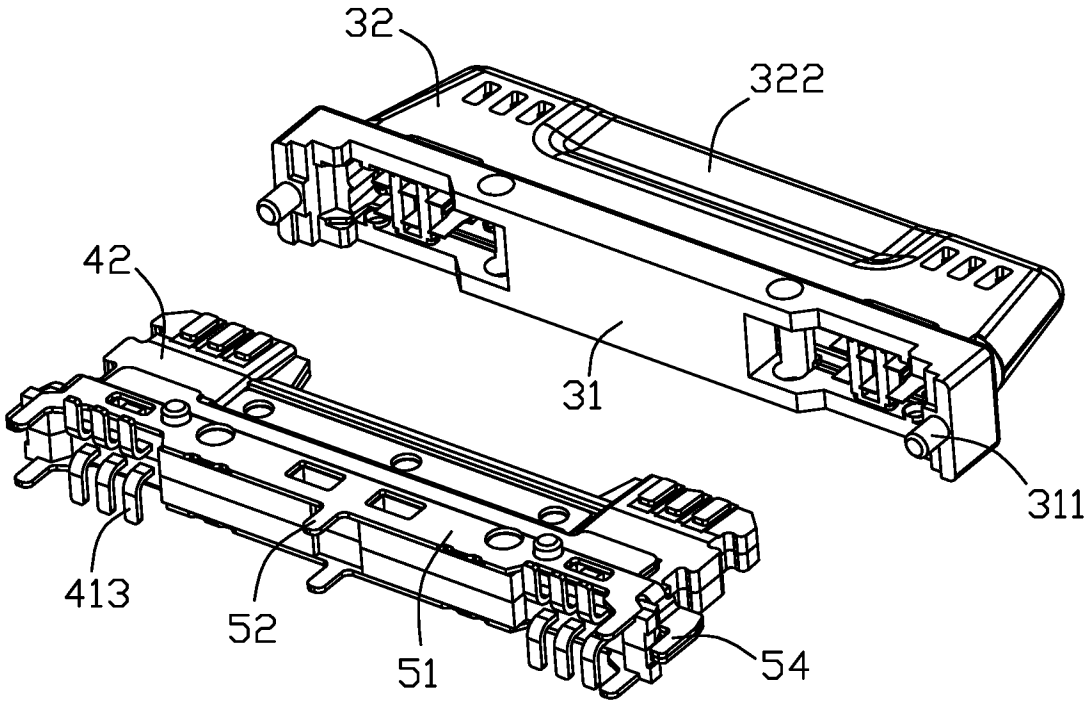
FIG. 7 is another exploded perspective view of the electrical connector of FIG. 5.
Figure 8:
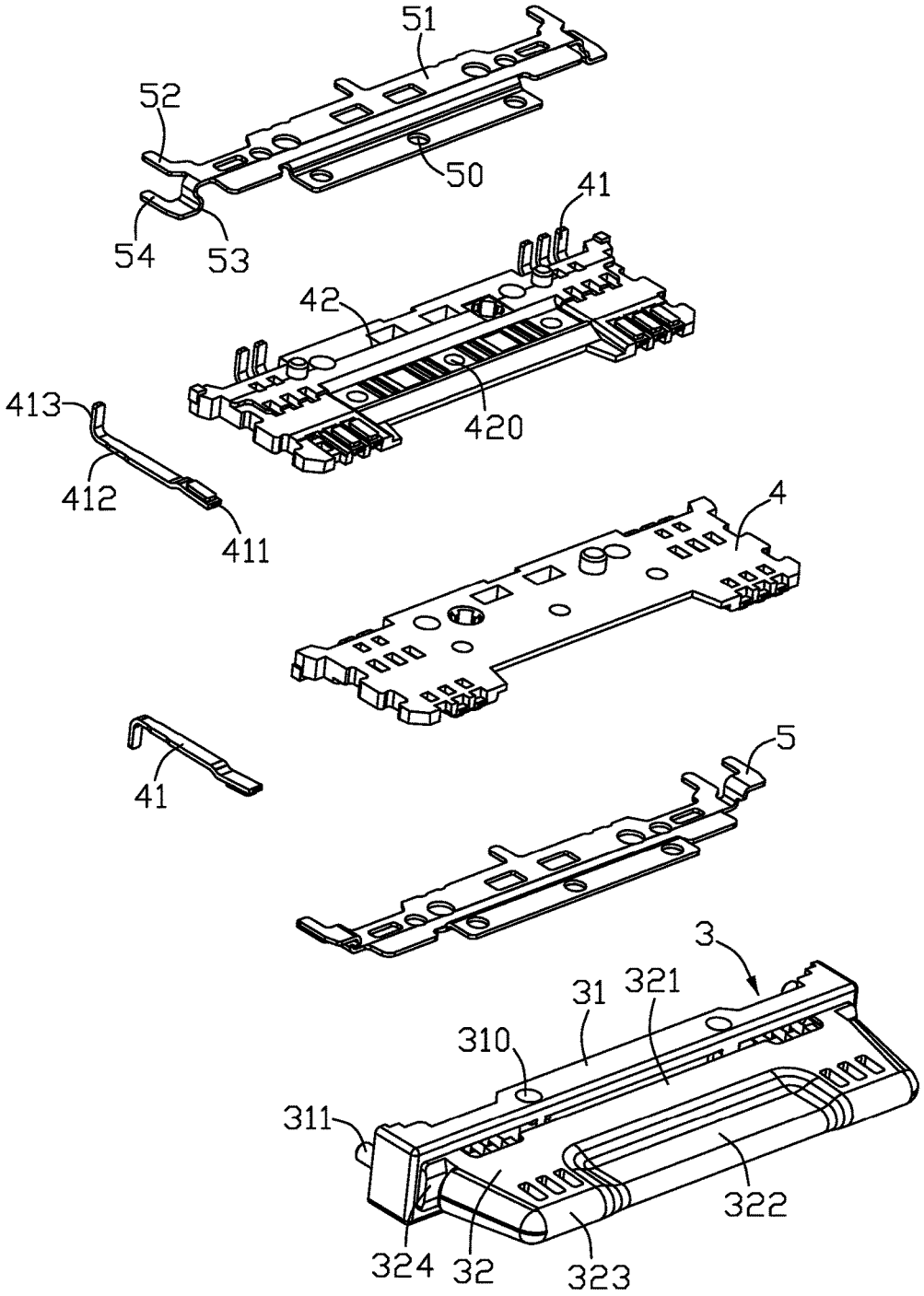
FIG. 8 is a further exploded perspective view of the electrical connector of FIG. 6.
Figure 9:
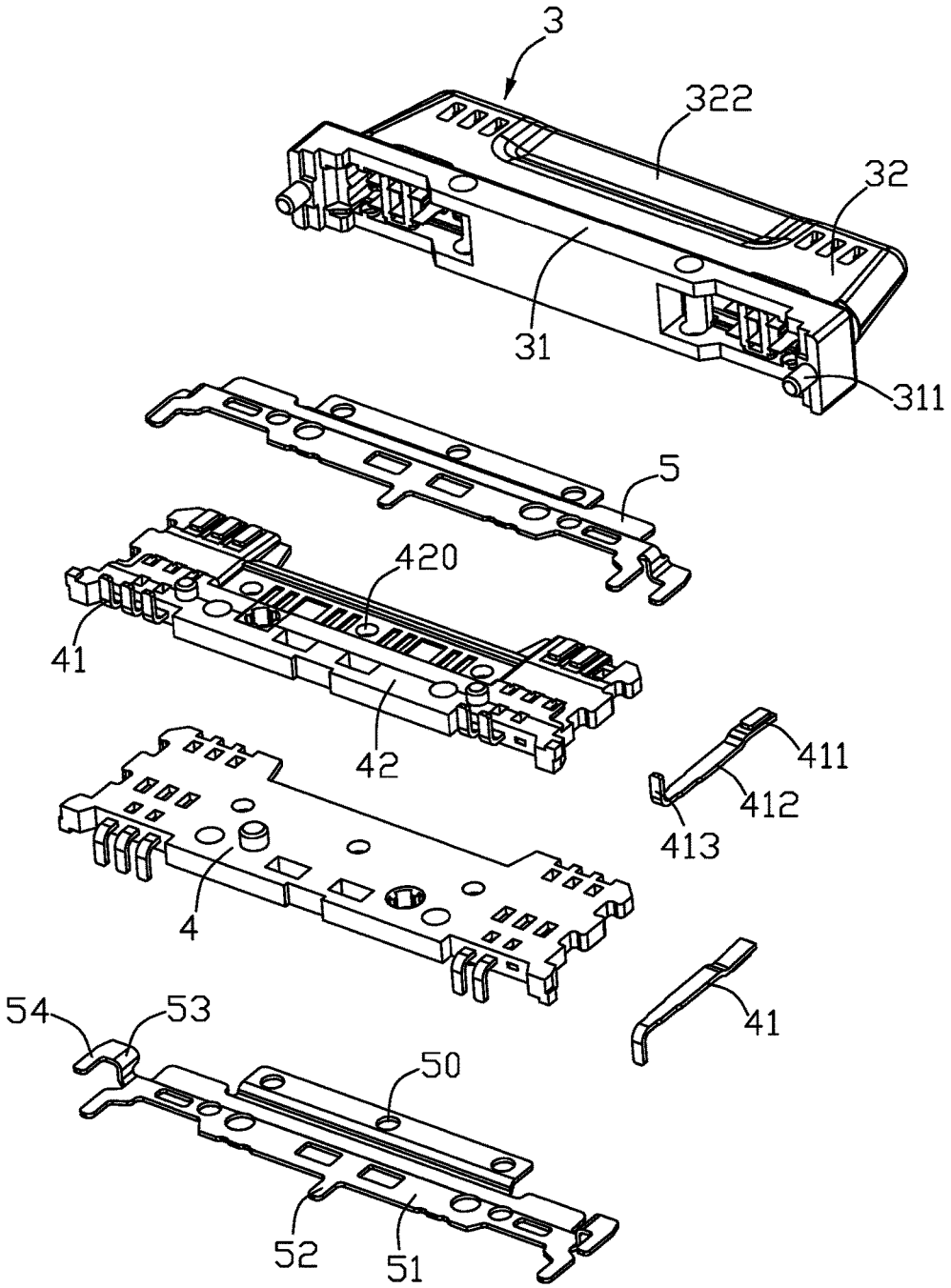
FIG. 9 is another further exploded perspective view of the electrical connector of FIG. 7.
Figure 10:
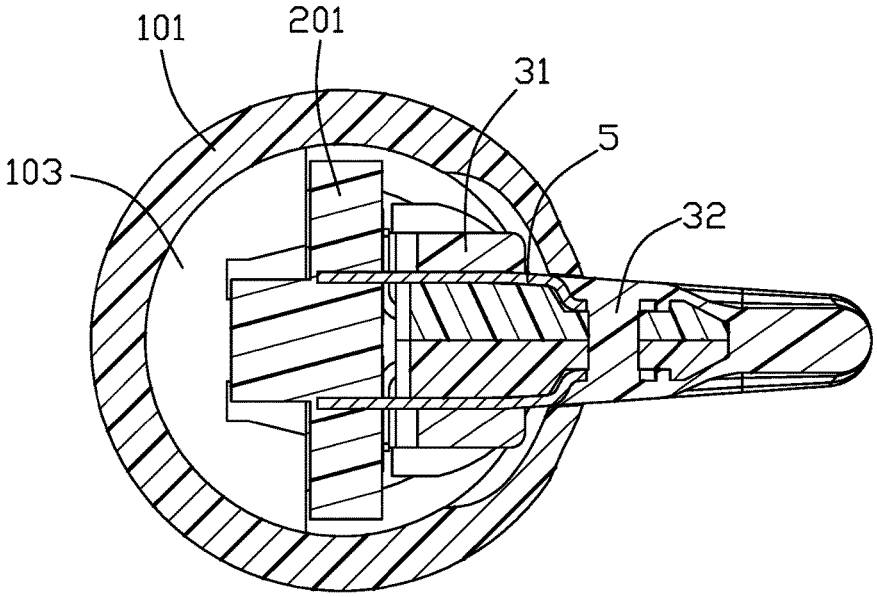
FIG. 10 is a cross-sectional view of the electrical connector assembly of FIG. 1 to show the reinforcing plate confronts confront the narrow slot where the shearing force may be applied.
Figure 10A:
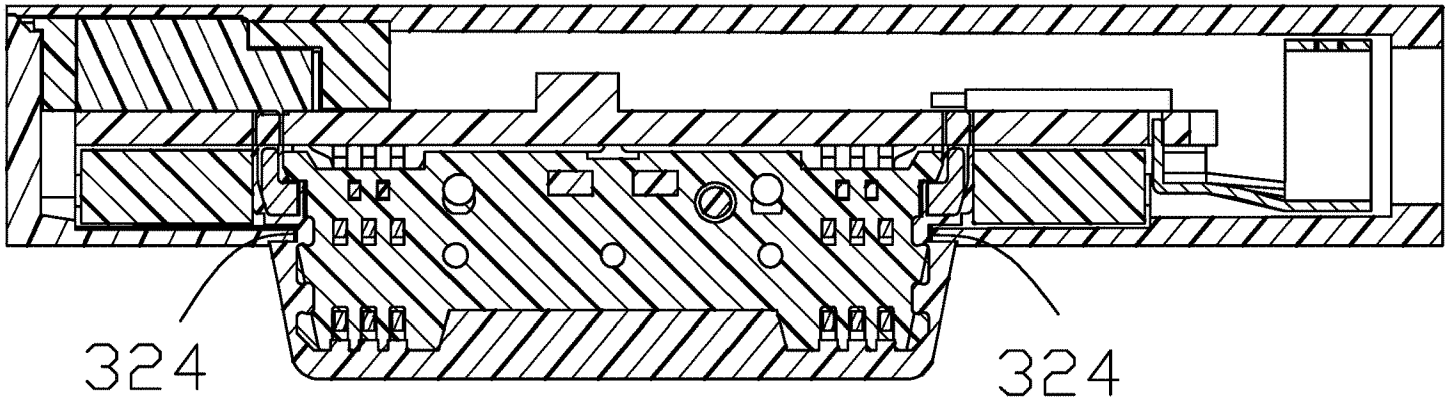
FIG. 10(A) is another cross-sectional view of the electrical connector assembly of FIG. 1 to show the notches of the tongue portion receive the corresponding parts of the holder.

Referring to FIGS. 1-10(A), an electrical connector assembly 1000 includes a cylindrical holder 100 extending along a longitudinal direction and an electrical connector unit 200 assembled in the holder 100. The holder 100 includes a tube 101 and the cap 102 positioned upon one end of the tube 101. The tube 101 has a narrow slot 1010 extending along the axial/longitudinal direction. The cap 102 includes a round lid 1021 and a sealing pole 1022 extending along one side of the lid 1021. After assembled, the lid 1021 covers the end opening of the tube 101 and the sealing pole 1022 covers the slot 1010.

The connector unit 200 includes a printed circuit board 201, a pair of magnets 202 and the subject connector 1 which is mechanically and electrically connected to the printed circuit board 201 in a surface mounting manner. The pair of magnets are located by two ends of the connector 1 and mounted upon the same surface of the printed circuit board 201 for attracting the complement connector during mating. The printed circuit board 201 is equipped with an LED 203 on the other surface for indicating the status during mating. The electrical connector assembly 1000 further includes a restriction block 103 on the interior surface of the tube 101 for holding the connector unit 200 in position within the tube 101.

The connector 1 includes a cover 3 enclosing a pair of terminal modules 4 and two reinforcing metal plates 5. The two terminal modules 4 joined together as a terminal module subassembly (not labeled), are originally made to be discrete from each other while successively stacked in a vertical/transverse direction perpendicular to both the axial direction and the front-to-back direction, and integrally formed with each other via the cover 3 in an overmolding process wherein the two reinforcing metal plates 5 are also disposed upon the outer surfaces of the terminal modules 4 during the overmolding process. After the overmolding process, the cover 3 includes a base 31 and a tongue portion 32 extending forwardly from the base 31.

The base 31 includes holes 310. The tongue portion 32 forms opposite mating surfaces 321 and a front face 323. Each mating surface 321 forms a recess 322 to reduce the mating force during mating. A root region of the tongue portion 32 forms a pair of notches for engagement within the notch 1010.

The terminal module 4 includes a row of terminals 41 and an insulator 42 retaining the terminals 41 via an insert-molding process. The terminals includes the contacting sections 411 exposed upon the mating surface 321, the tail sections 413 and the connecting sections 412 wherein the connecting sections are embedded within the insulator 42 while the contacting sections 411 and the tail sections 413 are exposed outside of the insulator 42. In this embodiment, the contacting sections are coplanar with the mating surface, and located by two sides of the recess 322 equally.

The reinforcing metal plate 5 includes the opening 50 aligned with the hole 420 of the insulator 42 so as to receive the material of the cover 3. The reinforcing metal plate 5 includes a main body 51 and a plurality of legs 52 extending rearwardly from the main body 51. The main body 51 is intimately located upon the surface of the insulator 42, and the legs 52 are mounted to the printed circuit board 201, both of which reinforce the connector 1 in the holder 100. Notably, when the electrical connector unit 200 is assembled into the tube 101, a root region of the tongue portion 32 including front exposed portions (not labeled) of the reinforcing metal plates 5 are received within the slot 1010 so that any shearing force imposed upon the root region of the tongue portion 32 will be absorbed by the reinforcing metal plates 5, thus avoiding breaking of the tongue portion 32. In addition, the front exposed portions may be grounded with the complementary connector during mating.

Figure 11A:
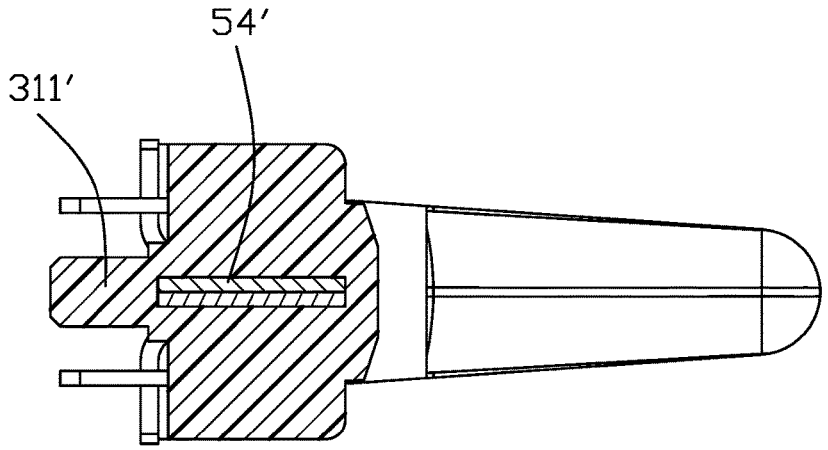
FIG. 11(A) is a cross-sectional view of the electrical connector of FIG. 11.
Figure 11B:
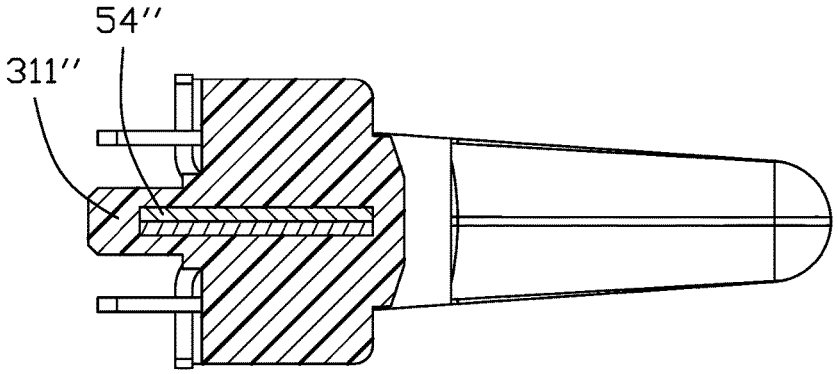
FIG. 11(B) is another cross-sectional view of the electrical connector according to another embodiment of the invention.
Figure 11C:
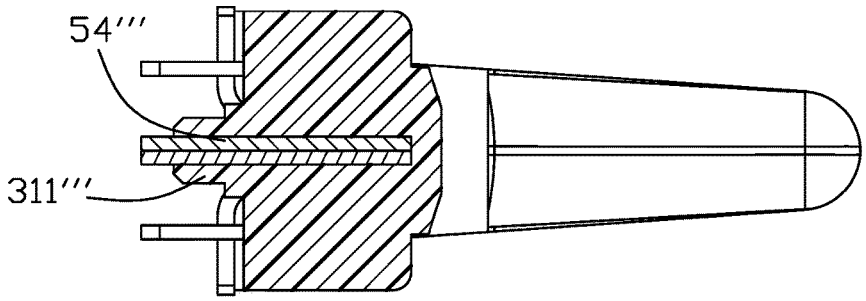
FIG. 11(*c*) is another cross-sectional view of the electrical connector according to another embodiment of the invention.

The reinforcing metal plate 5 further includes a pair of connecting sections 53 and the pair of mounting legs 54 extending rearwardly from the connecting sections 53. The mounting legs 54 of the two reinforcing metal plates 5 abut against each other in the transverse/vertical direction perpendicular to both the axial/longitudinal direction and the front-to-back direction. Notably, the cover 3 includes a pair of mounting posts 311 at two opposite ends. In this embodiment, the mounting legs 54' are terminated before reaching the corresponding mounting post 311' as shown in FIG. 11(A). Anyhow, in other embodiments as shown in FIG. 11(B), the mounting legs 54" extend into the corresponding mounting posts 311" for reinforcing the corresponding mounting posts 311", and in FIG. 11(C), the mounting legs 54''' further extend rearwardly beyond the corresponding shortened mounting posts 311''' for cooperating with the additional soldering in the corresponding holes of the printed circuit board for efficiently securing the connector 1 upon the printed circuit board 201. In brief, the additional reinforcing metal plates 5 may not only reinforce the connector unit 200 in the holder 100 during mating but also reinforce the connector 1 upon the printed circuit board 201.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a cylindrical holder including a slot extending through one end thereof along an axial direction;

an electrical connector unit received in the holder, and including:

a printed circuit board;

an electrical connector mounted upon the printed circuit board and including an insulative cover enclosing a pair of stacked terminal modules with associated reinforcing metal plates applied upon exterior surfaces of the corresponding terminal modules, respectively, said cover including a base and a tongue portion forwardly extending from the base along a front-to-back direction perpendicular to said axial direction and further being exposed outside of the holder; wherein a root region of the tongue portion is received within the slot, and portions of said pair of reinforcing metal plates are received in the slot to resist shearing forces imposed upon the tongue portion, wherein said portions of the pair of reinforcing metal plates are exposed to an exterior for grounding consideration, wherein a pair of notches are formed in two opposite ends of the root region of the tongue portion along the axial direction to receive corresponding portions of the holder, wherein said holder includes a tube in which the slot is formed, and a cap including a lid covering an end opening of the tube and a sealing pole covering the slot, and one of the notch receives a free end of the sealing pole, wherein each of said reinforcing metal plates includes a mounting leg embedded within a mounting post of said cover, and said mounting post is received within a corresponding hole in the printed circuit board.

2. The electrical connector assembly as claimed in claim 1, wherein the mounting leg extends rearwardly beyond the mounting post.

3. The electrical connector assembly as claimed in claim 1, wherein the mounting legs of said pair of reinforcing metal plates abut against each other in a transverse direction perpendicular to both the axial direction and the front-to-back direction.

4. The electrical connector assembly as claimed in claim 1, wherein each of said pair of reinforcing metal plates includes legs mounted to the printed circuit board.

5. The electrical connector assembly as claimed in claim 1, wherein said pair of terminal modules are stacked with each other in a transverse direction perpendicular to both said axial direction and said front-to-back direction.

6. An electrical connector assembly comprising:

an electrical connector unit including:

a printed circuit board;

an electrical connector including a pair of terminal modules stacked with each other in a vertical direction, a pair of reinforcing metal plates covering corresponding exterior surfaces of the terminal modules and integrally formed together in an insulative cover via an overmolding process, said cover including a base and a tongue portion extending forwardly from the base in a front-to-back direction perpendicular to said vertical direction; wherein each of the reinforcing metal plates includes legs mounted to the printed circuit board, and portions exposed upon the tongue portion in the vertical direction, wherein the base includes a mounting post, and each of the reinforcing metal plates includes a mounting leg aligned with the mounting post in the front-to-back direction, wherein said mounting leg is embedded within the mounting post.

7. The electrical connector assembly as claimed in claim 6, wherein said mounting leg extends rearwardly beyond the mounting post in the front-to-back direction.

8. The electrical connector assembly as claimed in claim 6, further including a cylindrical holder extending along a longitudinal direction perpendicular to both the front-to-back direction and the vertical direction, wherein said holder forms a slot extending along the longitudinal direction, and the tongue portion extends through said slot in the front-to-back direction with a root region of the tongue portion received within the slot.

9. The electrical connector assembly as claimed in claim 8, wherein the root region of the tongue portion forms a pair of notches at opposite ends in said longitudinal direction, to receive corresponding portions of the holder.

10. An electrical connector assembly comprising:

an electrical connector unit including:

a printed circuit board;

an electrical connector including a pair of terminal modules stacked with each other in a vertical direction, a pair of reinforcing metal plates covering corresponding exterior surfaces of the terminal modules and integrally formed together in an insulative cover via an overmolding process, said cover including a base and a tongue portion extending forwardly from the base in a front-to-back direction perpendicular to said vertical direction; wherein the base includes a mounting post, and the reinforcing metal plate includes a mounting leg aligned with the mounting post in the front-to-back direction, wherein said mounting leg is embedded within the mounting post, wherein the mounting post formed on one of the pair of reinforcing metal plates abuts against another mounting post formed on the other of the pair of reinforcing metal plates in the vertical direction.

11. The electrical connector assembly as claimed in claim 10, wherein said mounting leg extends rearwardly beyond the mounting post in the front-to-back direction.

* * * * *